US011787145B2

(12) United States Patent
Cheich

(10) Patent No.: US 11,787,145 B2
(45) Date of Patent: Oct. 17, 2023

(54) DUNNAGE CONVERSION SYSTEM AND METHOD FOR EXPANDING PRE-SLIT SHEET STOCK MATERIAL

(71) Applicant: Ranpak Corp., Concord Township, OH (US)

(72) Inventor: Robert C. Cheich, Independence, OH (US)

(73) Assignee: Ranpak Corp., Concord Township, OH (US)

( * ) Notice: Subject to any disclaimer, the term of this patent is extended or adjusted under 35 U.S.C. 154(b) by 40 days.

(21) Appl. No.: 17/531,962

(22) Filed: Nov. 22, 2021

(65) Prior Publication Data

US 2022/0080693 A1 Mar. 17, 2022

Related U.S. Application Data

(62) Division of application No. 15/541,414, filed as application No. PCT/US2016/017064 on Feb. 9, 2016, now Pat. No. 11,207,860.

(Continued)

(51) Int. Cl.
*B31D 5/00* (2017.01)
*B31D 1/00* (2017.01)

(52) U.S. Cl.
CPC ..... *B31D 5/0052* (2013.01); *B31D 1/0031* (2013.01); *B31D 5/0047* (2013.01);
(Continued)

(58) Field of Classification Search
CPC .. B31D 5/0047; B31D 5/0065; B31D 5/0052; B31D 5/0039; B31D 5/0043;
(Continued)

(56) References Cited

U.S. PATENT DOCUMENTS 2,294,478 A * 9/1942 Norris ..... B31D 1/0031 29/6.2
3,276,096 A * 10/1966 Mcaleer ..... B31D 1/0031 29/6.1

(Continued)

FOREIGN PATENT DOCUMENTS

DE 19911628 A1 9/2000
EP 0978372 A2 2/2000

(Continued)

OTHER PUBLICATIONS

International Search Report and Written Opinion dated May 2, 2016, for corresponding International Patent Application No. PCT/US2016/017064.

*Primary Examiner* — Thomas M Wittenschlaeger
(74) *Attorney, Agent, or Firm* — Renner, Otto, Boisselle & Sklar, LLP

(57) ABSTRACT

A dunnage conversion system for expanding an unexpanded slit sheet stock material to form an expanded dunnage product. The dunnage conversion system includes a converging chute to inwardly gather laterally-extending edges of sheet stock material towards one another, causing random crumpling of the sheet stock material to form a modified ply. The conversion system also includes feed wheels that advance the modified ply through the converging chute and pinch rollers that cooperate with the feed wheels to expand the modified ply traveling between the feed wheels and the pinch rollers to form a dunnage product. The expanded dunnage product is expanded both in a longitudinal feed direction and in thickness as compared to the unexpanded slit sheet stock material, and thus is a three-dimensional product having increased volume and lower density per unit of length as compared to the unexpanded slit sheet stock material.

8 Claims, 5 Drawing Sheets

Related U.S. Application Data

(60) Provisional application No. 62/121,046, filed on Feb. 26, 2015.

(52) U.S. Cl.
CPC .... *B31D 5/0065* (2013.01); *B31D 2205/0017* (2013.01); *B31D 2205/0023* (2013.01); *B31D 2205/0047* (2013.01)

(58) Field of Classification Search
CPC .... B31D 5/0056; B31D 5/006; B31D 5/0069; B31D 5/0073; B31D 1/0031; B31D 2205/0023; B31D 2205/0047; B31D 2205/0017; B31D 2205/0005
See application file for complete search history.

(56) References Cited

U.S. PATENT DOCUMENTS 4,699,609 A 10/1987 Komaransky et al.
5,123,889 A * 6/1992 Armington ..... B26D 1/30 83/628
5,538,778 A * 7/1996 Hurwitz ..... B31D 5/0065 428/338
5,593,376 A * 1/1997 Armington ..... B31D 5/0047 493/464
5,667,871 A * 9/1997 Goodrich ..... B31C 5/00 428/338
5,688,578 A * 11/1997 Goodrich ..... B65D 81/05 428/184
5,782,735 A * 7/1998 Goodrich ..... B31D 1/0031 83/175
5,873,809 A 2/1999 Kempster et al.
5,910,079 A * 6/1999 Watanabe ..... B31D 5/0065 493/464
6,416,451 B1 7/2002 Ratzel et al.
6,491,614 B1 * 12/2002 Harding ..... B31D 5/0047 493/24
7,186,208 B2 3/2007 Demers et al.
7,955,245 B2 * 6/2011 Cheich ..... B31D 5/0047 493/464
9,376,280 B2 6/2016 Page et al.
9,701,091 B2 7/2017 Page et al.
11,059,256 B2 * 7/2021 Cheich ..... B31D 1/0031
2008/0098699 A1 * 5/2008 Cheich ..... B65B 55/20 53/238
2009/0082187 A1 * 3/2009 Cheich ..... B31D 5/0052 53/472
2011/0218089 A1 9/2011 Demers et al.
2013/0296154 A1 * 11/2013 Sip ..... B31D 5/0047 493/464
2015/0140265 A1 5/2015 Page et al.
2015/0165717 A1 6/2015 Page et al.
2016/0130104 A1 5/2016 Page et al.
2018/0079161 A1 * 3/2018 Cheich ..... B31D 5/0052

FOREIGN PATENT DOCUMENTS

WO 95/07225 3/1995
WO 2010/057206 A2 5/2010
WO 2013/184649 A1 12/2013
WO 2015/103251 A1 7/2015
WO 2016/077728 A1 5/2016
WO 2017/039792 A1 3/2017
WO 2017/074535 A1 5/2017

* cited by examiner

DUNNAGE CONVERSION SYSTEM AND METHOD FOR EXPANDING PRE-SLIT SHEET STOCK MATERIAL

FIELD OF THE INVENTION

This application is a divisional of U.S. patent application Ser. No. 15/541,414, filed Jul. 3, 2017; which is a national stage of International Patent Application No. PCT/US2016/017064, filed Feb. 9, 2016 and was published in the English language; which claims priority to U.S. Patent Application No. 62/121,046, filed Feb. 26, 2015; the entire disclosures of which are hereby incorporated by reference.

BACKGROUND

In the process of shipping one or more articles from one location to another, a packer typically places some type of dunnage material in a shipping container, such as a cardboard box, along with the article or articles to be shipped. The dunnage material partially or completely fills the empty space or void volume around the articles in the container. By filling the void volume, the dunnage prevents or minimizes movement of the articles that might lead to damage during the shipment process. The dunnage also can perform blocking, bracing, or cushioning functions. Some commonly used dunnage materials are plastic foam peanuts, plastic bubble pack, air bags, and converted paper dunnage material.

Various types of conversion machines have been used to convert relatively planar, flat, substantially two-dimensional sheet stock material into a thicker, relatively less dense, three-dimensional dunnage product, such as a converted paper dunnage product. Some machines produce a void-fill dunnage product, used primarily to fill voids in a packaging container to prevent the contents from shifting during shipment. One objective in the design of these machines is to produce the void-fill dunnage product very rapidly.

Other conversion machines produce a dunnage product having cushioning characteristics that may not otherwise be obtainable from a void-fill dunnage product. These cushioning characteristics enable the dunnage product to cushion or secure one or more articles in a container and to protect the one or more articles from damage. Such cushioning is effected because the machines deform or otherwise shape the sheet stock material to impart adequate loft into the resulting dunnage product and impart sufficient stiffness and other characteristics to the dunnage product to ensure that it holds its shape.

SUMMARY OF THE INVENTION

While many dunnage conversion machines produce an adequate dunnage product, existing dunnage conversion machines and dunnage products might not be ideal for all applications. The present invention provides a dunnage conversion machine that is compact, easy to load, and produces an improved void-fill dunnage product using less sheet stock material than previous conversion machines. The resultant dunnage product has a higher ratio of volume per unit of length of sheet stock material used to produce the dunnage product compared to dunnage products produced by prior dunnage conversion machines.

More specifically, the present invention provides a dunnage conversion machine that includes a converging chute to inwardly gather lateral edges of a sheet stock material towards one another, causing random crumpling of the sheet stock material. The conversion machine also includes feed wheels that advance the sheet stock material through the converging chute and pinch rollers that cooperate with the feed wheels to expand the sheet stock material traveling therebetween. The resultant expanded dunnage product is a three-dimensional dunnage product having increased volume per unit of length as compared to the original unexpanded sheet stock material.

The sheet stock material is a slit sheet stock material, preferably a pre-slit sheet stock material, having a plurality of rows of slits with the rows spaced apart from one another. Each row includes a plurality of slits intermittently dispersed across the row. And the slits in each row are arranged in a staggered relationship relative to the slits in adjacent rows. The expansion of the slit sheet stock material refers to a three-dimensional expansion, or a volume expansion, of the slit sheet stock material caused by to the opening of the slits. During expansion, the material generally stretches in length and thickness while decreasing in width. This stretching and increase in thickness of the slit sheet stock material is referred to as expansion.

Accordingly, an exemplary dunnage conversion system includes a dunnage conversion machine and a supply of sheet stock material. The supply of sheet stock material a sheet stock material having a plurality of slits configured to expand under tension applied in a feed direction. A converging chute downstream of the supply converges in a feed direction from a relatively wider upstream end to a relatively narrower downstream end to randomly crumple the sheet stock material passing therethrough. Feed wheels downstream of the converging chute are driven to advance the sheet stock material in the feed direction. Pinch rollers disposed between the feed wheels and the supply are rotatable, and the feed wheels and the pinch rollers cooperate to apply tension in the feed direction to the sheet stock material traveling therebetween to expand the sheet stock material.

The pinch rollers and the feed wheels may be cooperatively arranged to selectively maintain an untorn length of the sheet stock material between the pinch rollers and the feed wheels during expansion of the sheet stock material therebetween.

The dunnage conversion system may further include a pair of pinch rollers and a pair of feed wheels, where one pinch roller of the pair of pinch rollers and one feed wheel of the pair of feed wheels are disposed on each of two opposed lateral sides of a feed path of the sheet stock material.

The feed wheels and the pinch rollers may rotate about parallel axes.

The converging chute may be configured to inwardly gather opposed lateral sides of the sheet stock material moving therethrough to randomly crumple the sheet stock material.

The pinch rollers may be movable towards one another to increase tension on the sheet stock material moving between the pinch rollers and the feed wheels.

Both the pinch rollers and the feed wheels may be disposed downstream of the converging chute.

The pinch rollers may be driven.

The dunnage conversion system may further include a controller configured to drive the feed wheels at a speed different from a speed of the pinch rollers.

In the supply of sheet stock material, each slit of the plurality of slits may extend in a lateral direction transverse to the feed direction.

The dunnage conversion system further includes guides extending along each of two opposed lateral sides of a feed path extending along the feed direction between the feed wheels and the pinch rollers, the guides extending adjacent the feed wheels and the pinch rollers to prevent binding of the sheet stock material about thereabout.

The guides may each include gaps therethrough, and the feed wheels and the pinch rollers extend through the gaps to engage the sheet stock material.

The dunnage conversion system further may include guide rollers downstream of the feed wheels and the pinch rollers, the guide rollers cooperating with the guides to constrain the thickness dimension of the sheet stock material, where the thickness dimension is generally orthogonal to a longitudinal direction of the feed path and generally orthogonal to a lateral dimension extending between the guides.

The present invention also provides a method of expanding a sheet stock material having a plurality of transverse slits that includes the steps of (a) laterally inwardly gathering the sheet stock material by causing opposed lateral ends of the sheet stock material to converge towards one another to form a randomly crumpled sheet stock material, and (b) expanding the randomly crumpled sheet stock material longitudinally and in thickness to form an expanded dunnage product. The expanding step includes advancing the sheet stock material in a longitudinal direction through a pair of driven feed wheels and a pair of pinch rollers disposed upstream of the feed wheels, the feed wheels and the pinch rollers cooperating to create tension in the randomly crumpled sheet stock material to cause the expansion of the slits.

The expanding step may further include driving the pair of feed wheels at a speed faster than a speed of rotation of the pinch rollers to create the tension.

The expanding step may further include expanding the sheet stock material travelling between the feed wheels and the pinch rollers while selectively maintaining an untorn length of the expanding sheet stock material travelling therebetween.

The advancing the sheet stock material may include advancing the sheet stock material from a supply through a converging chute where the laterally inwardly gathering step occurs.

The present invention further provides an expanded dunnage product that includes at least one ply of expanded slit sheet stock material having a plurality of spaced rows of expanded slits, the rows each including a plurality of transverse expanded slits intermittently dispersed across the sheet stock material. The at least one ply extends in a longitudinal direction along a discrete length and has lateral edges inwardly gathered towards one another. Additionally, the sheet stock material laterally extending between the lateral edges is randomly crumpled.

The expanded slits in each row may be periodically dispersed across a randomly crumpled lateral direction transverse the longitudinal direction.

The slits may be expanded in a direction transverse the direction of the slits cut through the sheet stock material.

The expanded dunnage product may have a randomly crumpled lateral width generally equivalent to a thickness of the expanded dunnage product.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The present invention provides an improved dunnage conversion machine that is compact, easy to load, and produces an improved void-fill dunnage product using less sheet stock material than previous conversion machines. Generally, the present invention provides a dunnage conversion system and method for converting a generally planar, two-dimensional sheet stock supply into a relatively increased volume, lower density, three-dimensional dunnage product. Particularly, the conversion system is capable of making, and the method provides for making, converted dunnage products having a three-dimensional shape and increased volume per unit of length as compared to the original unexpanded sheet stock material. The dunnage products are formed from at least one ply of slit sheet stock material having pre-cut slits intermittently disposed in rows extending transversely across the width of the sheet material.

Figure 1:
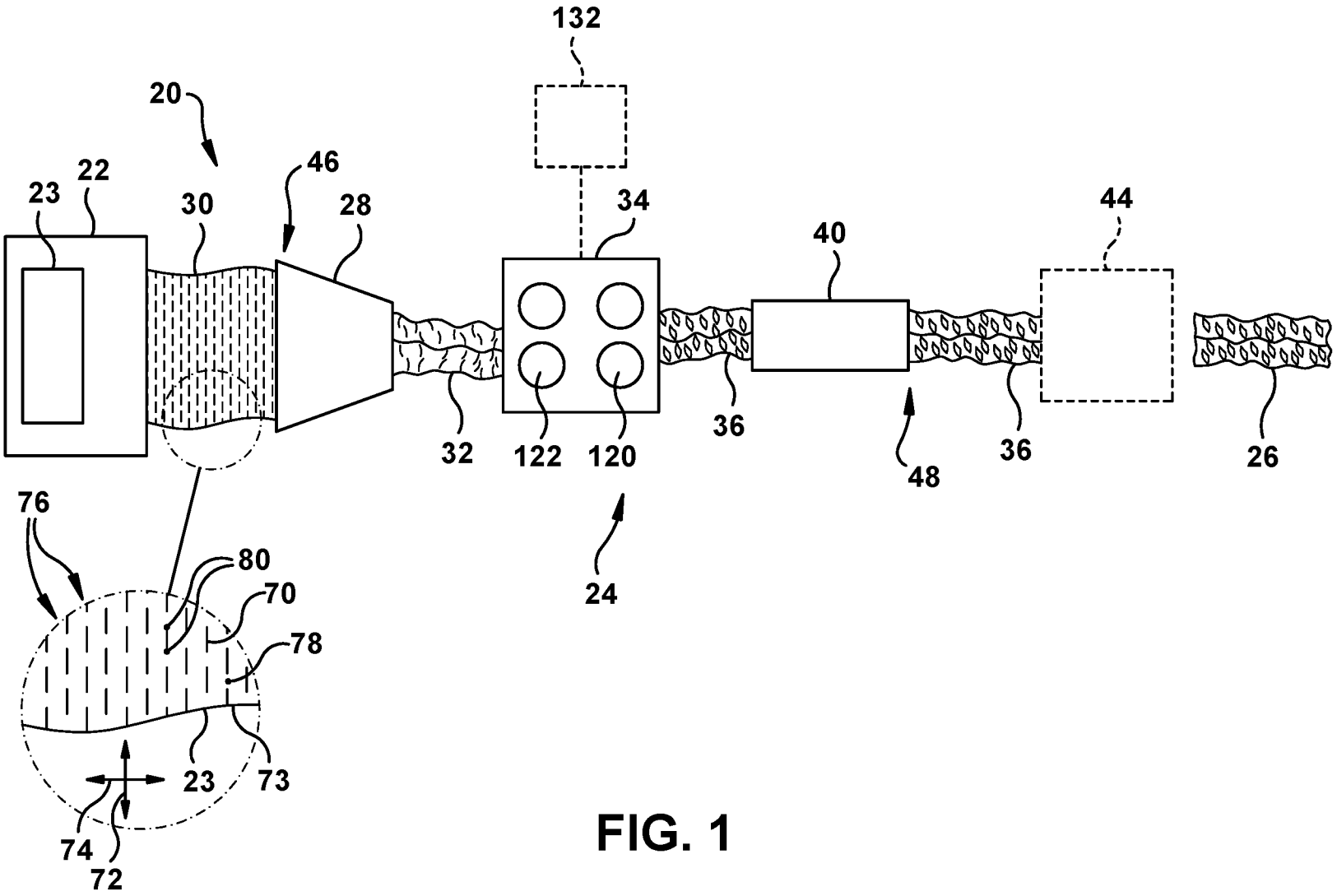
FIG. 1 is schematic view of an exemplary dunnage conversion system provided in accordance with the present invention.

Referring now to the drawings, and initially to FIG. 1, an exemplary dunnage conversion system 20 is shown schematically and includes a stock supply assembly 22, also herein referred to as a supply assembly 22, having a supply of slit sheet stock material 23, also herein referred to as sheet material 23, and a conversion machine 24. The conversion machine 24, also herein referred to as the machine 24, converts the sheet stock material 23 into discrete dunnage products 26.

Generally, the conversion machine 24 includes a converging chute 28, to receive and randomly crumple an initial ply 30 of the sheet stock material 23 to form a crumpled modified ply 32. The conversion machine 24 also includes an expansion assembly 34, to advance and expand the randomly crumpled modified ply 32, thereby expanding the slits of the sheet stock material 23 of the modified ply 32, and forming an expanded dunnage strip 36.

Further, it will be appreciated that the initial ply 30, the modified ply 32, and the expanded dunnage strip 36 are each portions of the sheet stock material 23 advancing through the conversion machine 24. As explained, the initial ply 30, modified ply 32, and expanded dunnage strip 36 are interconnected in an integral strip length until discrete dunnage products 26 are separated therefrom. Accordingly the initial ply 30 is generally transformed into the modified ply 32, which is then generally transformed into the expanded dunnage strip 36, which is in turn separated into discrete dunnage products 26.

Assisting in this transformation, the conversion machine 24 further includes an output chute 40, defining a path to guide the expanded dunnage strip 36 away from the machine 24. The machine 24 also may include an optional severing assembly 44 to sever discrete distinct dunnage products 26 from the expanded dunnage strip 36. While depicted as separate elements schematically for illustration purposes, any of the converging chute 28, expansion assembly 34, output chute 40, and severing assembly 44 may be integral with one another in other embodiments. For example, the expansion assembly 34 is shown as integral with the output chute 40 in FIGS. 2-4.

Figure 2:
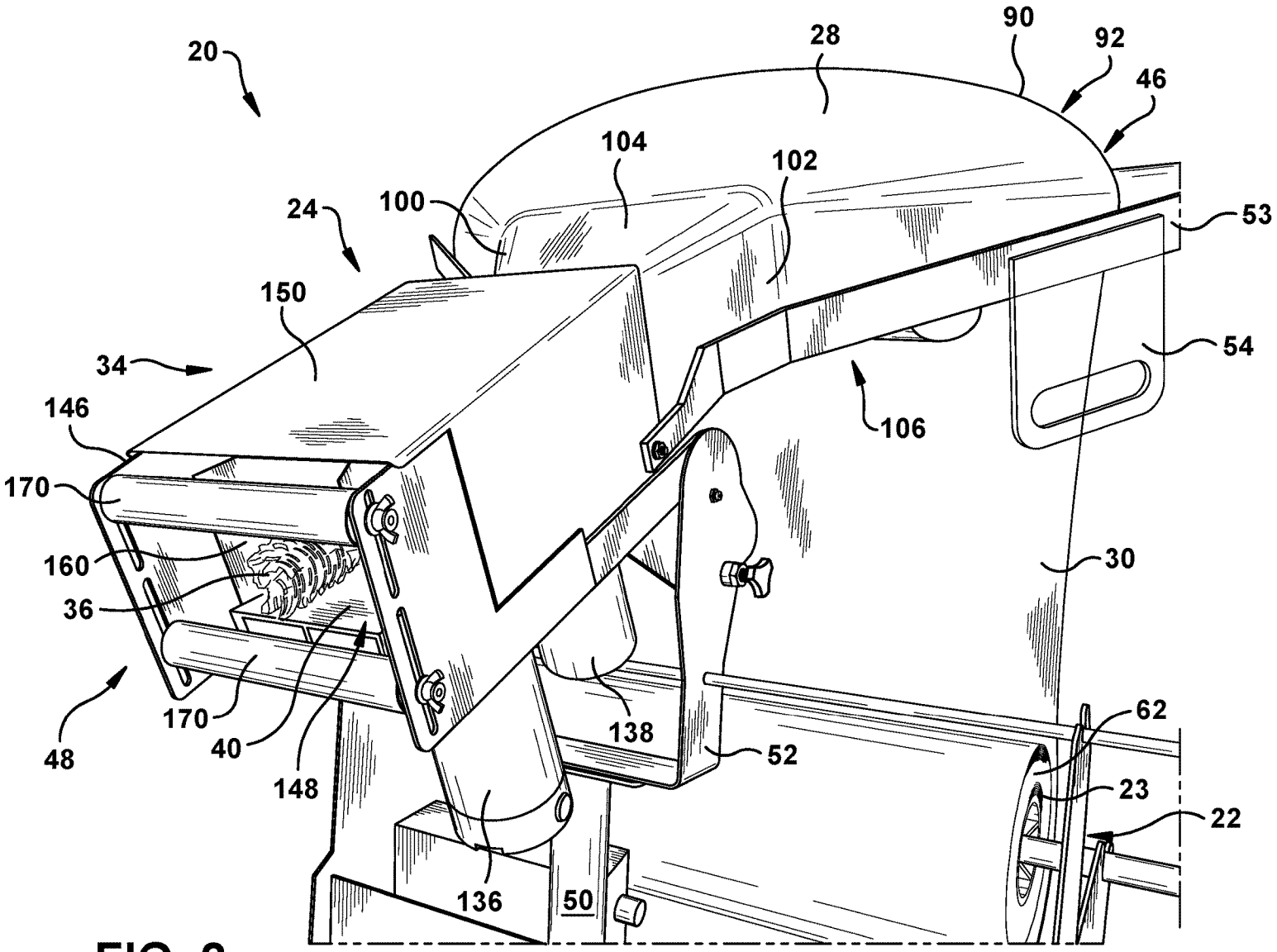
FIG. 2 is a perspective view of an exemplary dunnage conversion system provided in accordance with the present invention.
Figure 3:
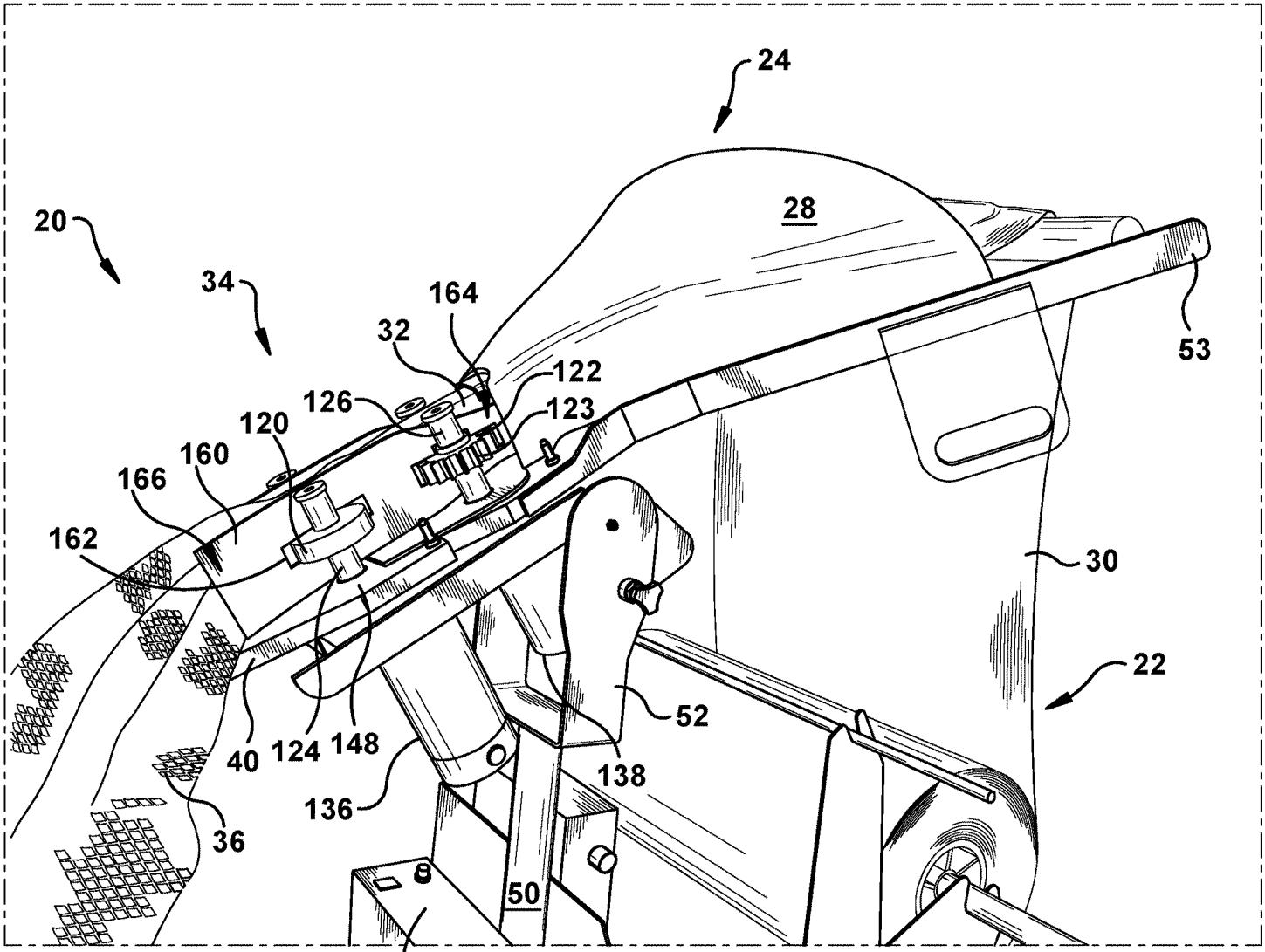
FIG. 3 is another perspective view of the exemplary dunnage conversion system of FIG. 2.
Figure 4:
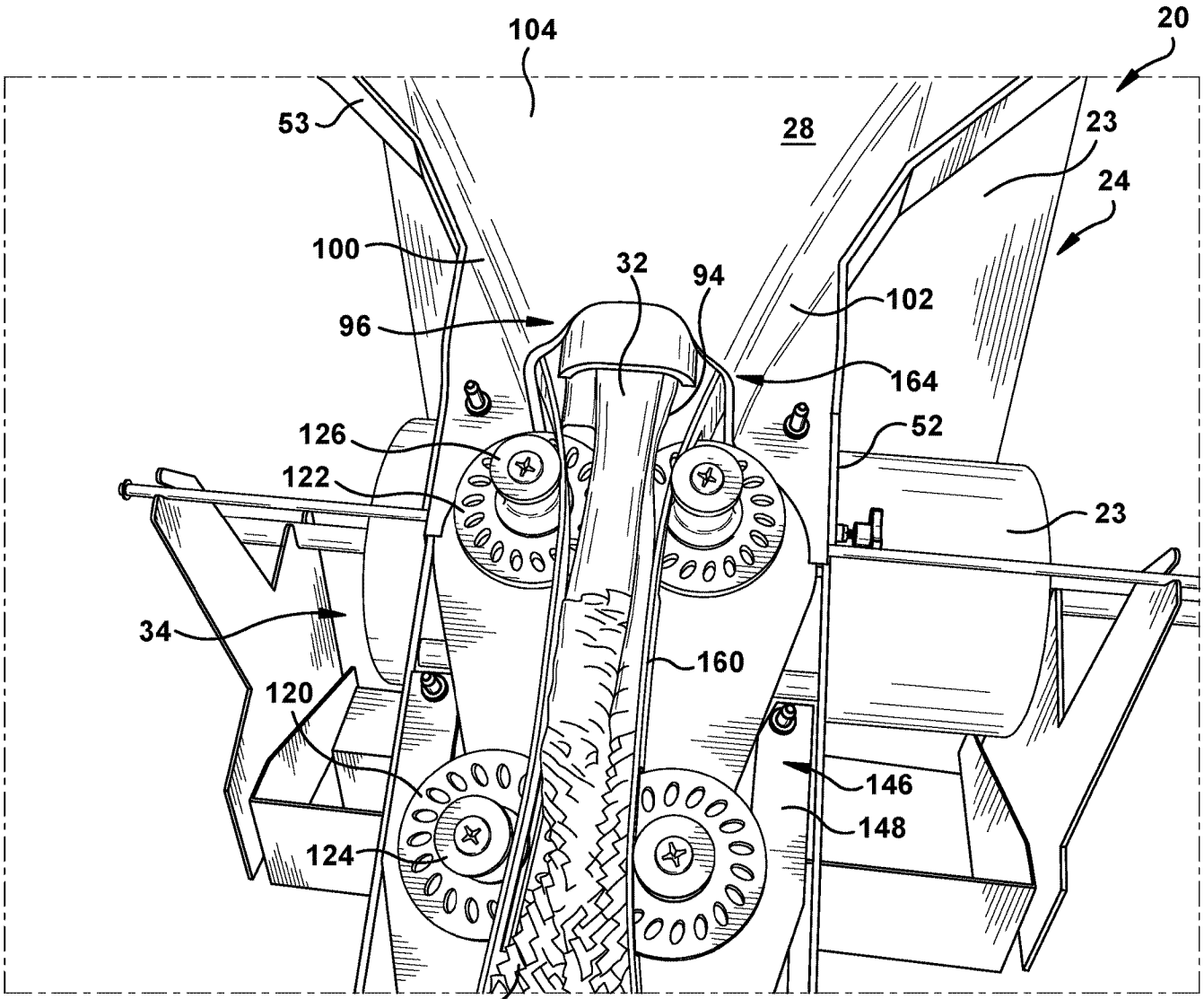
FIG. 4 is a top view of the exemplary dunnage conversion system shown in FIG. 3.

Turning now to FIGS. 2-4, an exemplary conversion system 20 is described in greater detail. As shown, the stock supply assembly 22 is separate from the conversion machine 24, though it may be integral with the machine 24 in other situations. The sheet material 23 advances from the stock supply assembly 22 to the conversion machine 24.

The stock supply assembly 22 is located upstream of the conversion machine 24 at an upstream end 46 of the conversion machine 24, and thus the conversion machine 24 is located downstream of the stock supply assembly 22. As used herein, the downstream direction is the direction of advancement of the initial ply 30 and its modified forms, the modified ply 32 and the dunnage strip 36 through the dunnage conversion system 20. In the downstream direction the sheet stock material 23 is drawn from the stock supply assembly 22 through the upstream end 46 (FIG. 1) of the conversion machine 24, and then converted into the relatively increased volume dunnage product 26 (FIG. 1). The upstream direction is thus the direction opposite the direction of advancement of the sheet stock material 23, from a downstream end 48 (FIG. 1) of the conversion machine 24 back toward the stock supply assembly 22.

The stock supply assembly 22 provided by the invention includes one or more supplies of sheet stock material 23. As shown, the sheet stock material 23 is supported on a stand 50 of the supply assembly 22. The stand 50 further supports the conversion machine 24, but in other embodiments, separate stands may be used. In some embodiments the sheet stock material 23 may be supported separately on a cart, or simply supported adjacent the conversion machine 24 and its respective support.

The stand 50 may be any suitable support, and may include an upright member that telescopes to enable raising and lowering the conversion machine 24 relative to the ground. Castors (not shown) may be coupled to a lower portion of the stand 50 to enable movement of the conversion system 20. In other embodiments, the stand 50 may include a foot from which an upright member of the stand extends to support the conversion machine 24 in a freestanding configuration. In even other embodiments, the stand 50 may include an attachment mechanism for a more permanent attachment, such as to a table top. It will also be appreciated that where the conversion machine 24 is separately supported from the supply assembly 22, the respective support of the conversion machine 24 may be configured as mentioned in any of the embodiments with reference to the stand 50.

As shown, the depicted stand 50 may include a mount 52 for supporting the conversion machine 24 and for enabling movement of the conversion machine 24 relative to the stand 50. The mount 52 is configured, such as having a base portion 53 pivotable on an axle, to enable tilting of the conversion machine 24 relative to the supply assembly 22 and to the ground. A tilting element (not shown), such as an electric cylinder, may be included in the depicted embodiment for precisely adjusting the angle of tilt of the conversion machine 24 on the mount 52 relative to the ground. In other embodiments, the mount 52 may move via any other suitable mechanism, such as via manual interaction with a handle 54 attached to the base portion 53 of the mount 52.

The stock supply assembly 22 also includes one or more constant entry guides 60, such as entry guide rollers. The depicted constant entry guide 60 is coupled to the base portion 53 of the mount 52, such as via suitable fasteners, though the guide 60 may be alternatively suitably located and/or coupled. The guide 60 guides the initial ply 30 of the sheet material 23 from the stock supply assembly 22 to the conversion machine 24, such as into the converging chute 28. Exemplary constant entry rollers are shown in U.S. Pat. No. 7,041,043, assigned to Ranpak Corp. of Concord Township, Ohio.

The constant entry guide 60 is arranged to provide uniform tension on the sheet material 23, thereby enabling efficient transfer of the sheet material 23 from the stock supply assembly 22 to the conversion machine 24. The constant entry guide 60 also may allow a constant entry angle for the initial ply 30 of sheet material 23 as it enters the converging chute 28, providing a relatively consistent quality of random crumpling in the modified ply 32 of sheet material 23.

The depicted sheet stock material 23 is a slit sheet stock material supplied in a roll 62 which is supported on the stand 50. One or more rolls 62 may be supported. An exemplary slit sheet stock material 23 is a single-ply kraft paper. Suitable kraft paper may have various basis weights, such as twenty-pound or forty-pound, for example. In some embodiments, the slit sheet material 23 may be laminated or be any other suitable material such as another paper, plastic sheets, or any combination thereof. In some embodiments, the slit sheet material 23 may be provided as a fan-folded stack having the material alternatingly folded into generally rectangular pages.

The exemplary slit sheet material 23 is configured for expanding in one or more dimensions, also herein referred to as volume expansion or volumetric expansion. When the slit sheet material 23 is stretched in a direction transverse the direction of the slits, the paper's longitudinal length and its thickness increase. The thickness dimension extends in a normal direction and is defined as generally orthogonal to the paper's longitudinal length and also generally orthogonal to a lateral extent extending between lateral edges 73 (FIG. 1) of the paper.

The thickness of the slit sheet material 23 can increase by an order of magnitude, or more, relative to its original thickness, when stretched in this manner. This longitudinal stretching and increase in thickness, in addition to the random crumpling of the paper to be further explained, results in the volumetrically expanded dunnage product 26. The increased volume allows the expanded dunnage product 26 to serve as a perforate protective void-fill for packaging articles in containers.

Particularly, an exemplary slit sheet material 23 includes a durable kraft paper with consecutive rows of slits die-cut into the paper for expansion in a longitudinal feed direction and also in thickness. As a result of the expansion, the paper may be reduced in a lateral direction, though the resultant volume may yield up to twenty-fold the volume as compared to the unexpanded slit sheet material 23 provided in the supply assembly 22. An exemplary slit sheet material, and the manufacturing thereof, are described in greater detail in U.S. Pat. Nos. 5,667,871 and 5,688,578, the disclosures of which are incorporated herein by reference in their entireties.

Referring again briefly to FIG. 1, the exemplary slit sheet material 23 includes slits 70 configured to expand along a feed direction. Accordingly, the slits 70 are cut through the sheet material 23 and extend in a lateral direction 72 across the paper between the lateral edges 73. The lateral direction 72 is transverse a longitudinal feed direction 74 of the material 23. Of course other embodiments may include slits extending along another suitable angle or along more than one angle relative to the feed direction.

Preferably, the rows 76 of slits 70 are generally parallel to one another and are generally periodically, and preferably equally, spaced from one another, though the rows 76 may be otherwise suitably arranged in other embodiments. The slits 70 are intermittently dispersed across the rows 76, with the slits 70 of each row generally being staggered in relation to slits 70 of directly adjacent rows 76, though the slits 70 may be otherwise suitably arranged in other embodiments. Across each row 76 of slits 70, there may be a greater length of combined slits 70 than a length of un-slit portions 78 disposed between slit endpoints 80, providing for a maximal amount of expansion of the slit sheet material 23.

Turning back to FIGS. 2-4, the exemplary slit sheet material 23 received from the supply assembly 22 is first fed into the converging chute 28. The converging chute 28, also herein referred to as the chute 28, is disposed downstream of the supply assembly 22 and is at least partially supported relative to the supply assembly 22, such as via the mount 52. The mount 52 and the chute 28 are coupled to one another, preferably via fasteners, or via any other suitable method such as welding, adhesives, etc.

The converging chute 28 is configured, such as shaped, to randomly crumple the relatively planar, uncrumpled and non-extended initial ply 30 traveling through the chute 28. The chute 28 defines a path therethrough that causes inward gathering of opposed laterally extending edges, also herein referred to as lateral edges, of the initial ply 30 travelling along the path. The inward gathering as the initial ply 30 is advanced in the feed direction causes the lateral edges to converge towards one another, thereby randomly crumpling the initial ply 30. In this way, the initial ply 30 is transformed into the randomly crumpled modified ply 32 upon exit from the converging chute 28.

To define the path, the chute walls converge from a relatively larger inlet 90 at an upstream end 92 to a relatively smaller outlet 94 at a downstream end 96. Thus the walls of the chute 28 inwardly converge in a downstream direction. As shown, side walls 100 and 102 inwardly converge in the downstream direction, whereby the chute 28 has a narrower width dimension at its downstream end 96 as compared to a width dimension at its upstream end 92. The constant entry guide 60 is spaced from the upstream end 92 of the chute 28 and arranged to guide the sheet material 23 to the converging chute 28 such that the width dimension of the sheet material 23 is approximately parallel to the width dimension of the chute 28.

The converging chute 28 also includes upper and lower portions connecting the side walls 100 and 102. For example, the chute 28 includes an upper portion 104 opposing a lower portion 106. The upper portion 104 inwardly converges in the downstream direction towards the lower portion 106 along a distance between the upstream end 92 and the downstream end 96.

The height of a feed path disposed along a feed direction between the upper and lower portions 104 and 106, and the width of the feed path between the respective side walls 100 and 102, decreases over a longitudinal distance from the upstream end 92 to the downstream end 96 of the chute 28. Therefore, the inlet 90 of the chute 28 has a larger cross-sectional area as compared to the cross-sectional area of the outlet 94.

The resultant randomly crumpled modified ply 32 exiting the chute 28 has a reduced width and increased thickness and occupies a larger volume as compared to the respective uncrumpled initial ply 30 from which it is transformed. While some minor expansion of the slits may occur due to the random crumpling effect, the majority of the slit expansion occurs downstream of the random crumpling effected via the chute 28.

As illustrated best in FIGS. 3 and 4, the expansion assembly 34 is located adjacent the converging chute 28 and downstream of the supply assembly 22 as well as downstream of the converging chute 28. The expansion assembly 34 is configured to advance the sheet material 23 through the conversion machine 24 and to expand the sheet material 23, such as the modified ply 32 received from the converging chute 28.

The expansion assembly 34 includes feed wheels 120 for advancing the sheet material 23 in the feed direction. Also included are pinch rollers 122 that cooperate with the feed wheels 120 to apply tension to the sheet material 23 traveling therebetween to expand the sheet material 23. The tension applied to the modified ply 32 as it passes between the feed wheels 120 and the pinch rollers 122 causes expansion of the slits and corresponding volumetric expansion of the modified ply 32 to form the expanded strip 36.

The expansion assembly 34 is at least partially supported via the mount 52 and is coupled to the chute 28 via the mount 52. The mount 52 and the expansion assembly 34 are coupled to one another preferably via fasteners, or via any other suitable method such as welding, adhesives, etc. In other embodiments, the expansion assembly 34 may be integral with the chute 28 and/or portions of the expansion assembly 34 may be disposed upstream of or within the chute 28 but still downstream of the supply assembly 22. For example, in one situation the pinch rollers 122 may be disposed within a portion of the converging chute 28 to receive randomly crumpled sheet material.

The feed wheels 120 and pinch rollers 122 include radially outwardly extending gripping portions 123, such as teeth, for engaging the modified ply 32. The wheels 120 and rollers 122 may be made of any suitable material, such as rubber, and may be of any suitable size. For example, each of the depicted rollers 122 and wheels 120 are closely sized to one another, and typically are identical to one another.

In some embodiments, the wheels 120 or rollers 122 may have larger gripping portions 123. In one example, the rollers 122 may have larger gripping portions 123 to enable greater pressure to be applied to the modified ply 32, while the smaller gripping portions 123 of the wheels 120 may be sized for quickly advancing the modified ply 32 therebetween, consequently increasing expansion of the modified ply 32.

The feed wheels 120 and the pinch rollers 122 are cooperatively arranged to selectively maintain an untorn length, also referred to as a unitary length, of the modified ply 32 of the sheet material 23 therebetween during expansion of the modified ply 32 also therebetween. For example, the illustrated expansion assembly 34 has a pair of feed wheels 120 and a pair of pinch rollers 122 located downstream of the supply assembly 22, and preferably downstream of the converging chute 28. The feed wheels 120 are disposed further downstream than the pinch rollers 122 to facilitate expansion of the sheet material 23. In other embodiments, any suitable number of feed wheels 120 and/or pinch rollers 122 may be used.

One pinch roller 122 of the pair of pinch rollers 122 and one feed wheel 120 of the pair of feed wheels 120 are disposed on each of the opposed lateral sides of a feed path, disposed along a feed direction, of the crumpled modified ply 32 moving therebetween. Preferably, the feed wheels 120 and the pinch rollers 122 rotate about parallel axes to promote linear advancement of the modified ply 32 and to enable the greatest amount of expansion of the modified ply 32 extending between the feed wheels 120 and the pinch rollers 122. As shown, the feed wheels 120 are supported on feed axles 124 and the pinch rollers 122 are supported on roller axles 126, disposed at the respective parallel axes.

At least the feed axles 124, and thus the feed wheels 120, are driven, preferably by a motor, such as an electric motor. The driving of the feed wheels 120 and engagement of the feed wheels 120 with the modified ply 32 travelling therebetween causes the sheet stock material 23, including the initial ply 30 and modified ply 32, to be advanced in the feed direction. As such, the initial ply 30 is drawn from the supply assembly 22, through the converging chute 20 and through the expansion assembly 34 towards the downstream end 48 of the conversion machine 24. Concurrently, the pinch rollers 122 are configured to apply tension to the modified ply 32 being advanced by the feed wheels 120 to cause expansion of the modified ply 32 extending between the feed wheels 120 and the pinch rollers 122.

To cause this tension, the roller axles 126 also may be driven, and thus the pinch rollers 122 also may be driven members. The pinch rollers 122 are driven at a different speed than the feed wheels 120, and generally at a slower speed than the feed wheels 120. In this way, the sheet material 23 downstream of the pinch rollers 122 advances at a greater speed than the sheet material 23 passing between the opposed pinch rollers 122. This leads to stretching of the modified ply 32 and expansion of the slits downstream of the pinch rollers 122. In turn, the modified ply 32 is reduced in lateral width but increased in thickness and in length in the longitudinal direction to form the expanded dunnage strip 36.

A controller 132 is provided for separately driving the pinch rollers 122 at a speed slower than a speed of the feed wheels 120. The controller 132 may be coupled to the stand 50, or to any other suitable location of the conversion system 20, and is communicatively coupled to a feed motor 136 and a roller motor 138. The feed motor 136, such as an electric motor, is coupled to the feed axles 124 to drive the feed wheels 120. The roller motor 138, such as an electric motor, is likewise coupled to the roller axles 126 to drive the pinch rollers 122.

The controller 132 may include a program having predetermined speeds at which the motors 136 and 138 are run, or the speeds may be selectively controlled via a manual input of the controller 132 by a user. By allowing for selective speeds, the rate of feed through the conversion machine 24 can be slowed down or sped up. Also the extent of volumetric expansion of the sheet material 23 can be increased or decreased via respective increased or decreased tension on the modified ply 32 via further respectively increasing or decreasing a speed differential between a feed wheel speed and a pinch roller speed. In some situations, the feed motor 136 and the roller motor 138 may be controlled by separate controllers.

In some embodiments, the pinch rollers 122 may be movable towards one another to increase tension on the sheet material 23 moving between the pinch rollers 122. Thus, the roller axles 126 may be linearly movable towards one another, preferably while maintaining their parallel relationship to one another. For example, in an alternative embodiment where the pinch rollers 122 are not driven, the movement of the roller axles 126 may be used to increase the tension in the sheet material 23, causing the expansion of the sheet material 23. In some embodiments where the pinch rollers 122 are not driven, the roller axles 126 may be rotatably constrained via increased friction applied to the roller axles 126. The increased friction may be applied via bushings or other suitable components. In such case, the increased friction on the roller axles 126 enables the expansion of the modified ply 32.

The feed wheels 120 and the pinch rollers 122 are disposed in an expansion housing 146 which also at least partially engages the downstream end 96 of the chute 28 to define a path for the randomly crumpled modified ply 32 through the expansion assembly 34. A base portion 148 engages the mount 52 and supports the axles 124 and 126, such as via suitable fasteners. A lid portion 150 (FIG. 2) of the expansion housing 146 is removably coupled to the base portion 148 to allow access to the feed wheels 120 and to the pinch rollers 122, such as for maintenance operations. In other embodiments, the lid portion 150 may be omitted. The expansion housing 146 at least partially circumferentially constrains the crumpled modified ply 32 to direct the modified ply 32 through the feed wheels 120 and the pinch rollers 122 for maximal expansion of the slits, and to prevent binding of the modified ply 32 or of the expanded dunnage strip 36 thereabout.

The expansion assembly 34 further includes guides, such as guide plates 160, which cooperate with the housing 146 to direct the modified ply 32 through the feed wheels 120 and the pinch rollers 122 for maximal expansion of the slits, and to prevent binding of the modified ply thereabout. A pair of guide plates 160 are shown in the illustrated expansion assembly 34, with one guide plate 160 disposed on each of the opposed lateral sides of the feed path of the sheet material 23 through the expansion assembly 34. In this manner, the guide plates 160 are disposed adjacent the feed wheels 120 and the pinch rollers 122 to prevent binding of the sheet material 23 thereabout.

The illustrated guide plates 160 extend substantially continuously from an upstream end of the expansion assembly 34, upstream of the pinch rollers 122, to a downstream end of the expansion assembly, downstream of the feed wheels 120. More particularly, the guide plates 160 each include gaps 162 extending through the guide plates 160, where the feed wheels 120 and pinch rollers 122 extend through the gaps 162 to engage the sheet material. A height of the guide plates 160 extends along the axles 124 and 126, and preferably a height of the guide plates 160 is greater than a thickness or height of the crumpled ply being drawn through the expansion assembly 34. Thus the guide plates 160 extend in height from the base portion 148 to an uppermost point of the adjacent axles 124 and 126. This construction prevents the crumpled ply from wrapping over the guide plates 160 and binding with the axles 124 and 126 or with the feed wheels 120 or the pinch rollers 122, and facilitates feeding a leading end of sheet material through the expansion assembly 34 as well as maintaining a generally consistent expansion of the modified ply 32 passing through the expansion assembly 34.

An upstream end 164 of each guide plate 160 is constrained from moving, such as via coupling to the base portion 148 or to the downstream end 96 of the converging chute 28. A downstream end 166 of each guide plate 160 extends along the feed path though the expansion assembly 34 and also may be constrained from moving, such as via a connection to the base portion 148. As depicted the lateral distance between the guide plates 160 may be greater at the downstream ends 166 as compared to a lateral distance at an intermediate location of the guide plates between the upstream and downstream ends 164 and 166, thus facilitating lateral expansion of the paper.

In other embodiments, the downstream ends 166 may be unconstrained, and may be allowed to move, such as to float relative to the feed wheels 120 and to the pinch rollers 122, to allow for varying widths of the modified ply 32 passing between the opposed guide plates 160. Such construction may assist in preventing binding or jamming of the expanding ply in the expansion assembly 34.

The guide plates 160 may be made of a moderately flexible material, such as a plastic, such as a moderately flexible acetal polymer. Further, while the guide plates 160 are shown as being generally rectangular, the shape of the guide plates 160 may take other suitable form in other embodiments.

The guide plates 160 guide the sheet material 23 from an upstream end of the expansion assembly 34 to a downstream end of the expansion assembly 34, disposed adjacent the output chute 40. The output chute 40 guides the sheet material 23 exiting the expansion assembly 34 towards a user or towards a container waiting for the void-fill material. The output chute 40 is shown as integral with the expansion assembly 34 and as being relatively short in longitudinal length. Though in other embodiments, the output chute 40 may be of any suitable length, may not be integral with the expansion assembly 34, and/or may be omitted.

Guide rollers 170 (FIG. 2) also may be included in the expansion assembly 34, or separate from the assembly 34 in other embodiments. The depicted guide rollers 170 are located downstream of the converging chute 28, downstream of the feed wheels 120 and of the pinch rollers 122 in the illustrated embodiment, though the guide rollers 170 may be placed in other suitable locations. The guide rollers 170 freely rotate along respective axes to facilitate the advancement of the dunnage strip 36 from the expansion assembly 34, and thus from the conversion machine 24. As shown, the guide rollers 170 are rotatably coupled to the remainder of the conversion machine 24, such as to the base portion 148 of the expansion assembly 34.

The guide rollers 170 cooperate with the guides 160 to constrain the thickness dimension of the dunnage strip 36 passing therebetween. The thickness dimension is generally orthogonal to a longitudinal direction of the feed path and generally orthogonal to a lateral dimension extending between the guides 160. Accordingly, via cooperation of the guide rollers 170 and the guides 160, the density and volume of the expanded dunnage strip 36 is generally constrained at its output from the conversion machine. The guides 160 laterally constrain the lateral dimension and the guide rollers 170 constrain the thickness dimension of the crumpled and expanded dunnage product 36, the lateral dimension extending between lateral edges 73 (FIG. 1) of the paper The resultant expanded dunnage strip 36 output from the expansion assembly 34 has an increased thickness and length, and consequently a decreased width, as compared to the modified ply 32 received into the expansion assembly 34. The dunnage strip 36 is expanded due to the stretching or opening of the slits cut through the sheet material 32, due to the tension applied to the modified ply 32 between the feed wheels 120 and the pinch rollers 122. The dunnage strip 36 has a randomly crumpled form similar to the modified ply 32, due in part to being constrained by a combination of the feed wheels 20, pinch rollers 122, guide plates 160, and expansion assembly body 146. Thus the resultant dunnage strip 36 is both volumetrically expanded and randomly crumpled, and is provided in a continuous length until discrete portions are separated to form the discrete dunnage products 26.

The discrete dunnage products 26 may be separated via cooperation of the pinch rollers 122 and the feed wheels 120 into any desired length. Thus the conversion machine 24 may be configured to automatically separate a desired length of dunnage product 26 from the dunnage strip 34. Perforations in the sheet material 23 may not be necessary to achieve the separation due to the perforate nature of the dunnage strip 34 caused by the expanded slits.

This separation can be accomplished by providing an increased speed differential between a downstream feed wheel speed and an upstream pinch roller speed. Accordingly, the rotational speed of the pinch rollers 122 may be decreased or stopped altogether, and/or the rotational speed of the feed wheels 120 may be maintained or increased. The differential change in speed may be momentary, providing for just enough time for the tearing of a length of the sheet material 23 disposed between the pinch rollers 122 and the feed wheels 120 to separate a discrete downstream length of the dunnage strip 34 into a dunnage product 26. Subsequently the relative rotational speeds of the pinch rollers 122 and feed wheels 120 may be returned to the pre-separation speeds to continue the expansion of the modified ply 32 extending therebetween.

The conversion machine 24 may additionally or alternatively include an optional severing assembly 44 (FIG. 1) for separating discrete lengths from the expanded dunnage strip 36. The severing assembly 44 may include one or more cutting members, which may be actuated manually or automatically via communicative coupling with the controller 132 or with another controller. An exemplary severing assembly is described in U.S. Pat. No. 4,699,609 to Ranpak Corp. of Concord Township, Ohio. In some situations, the severing assembly 44 may be omitted altogether, such as when discrete lengths of sheet material are supplied to the conversion machine 24.

Another separating alternative is to employ a sheet stock material 23 that is already separated into discrete lengths, though additional loading of each consecutive length into the conversion machine 24 may be required. Yet another alternative is to manually tear the discrete dunnage products 26 from the dunnage strip 34.

Figure 5:
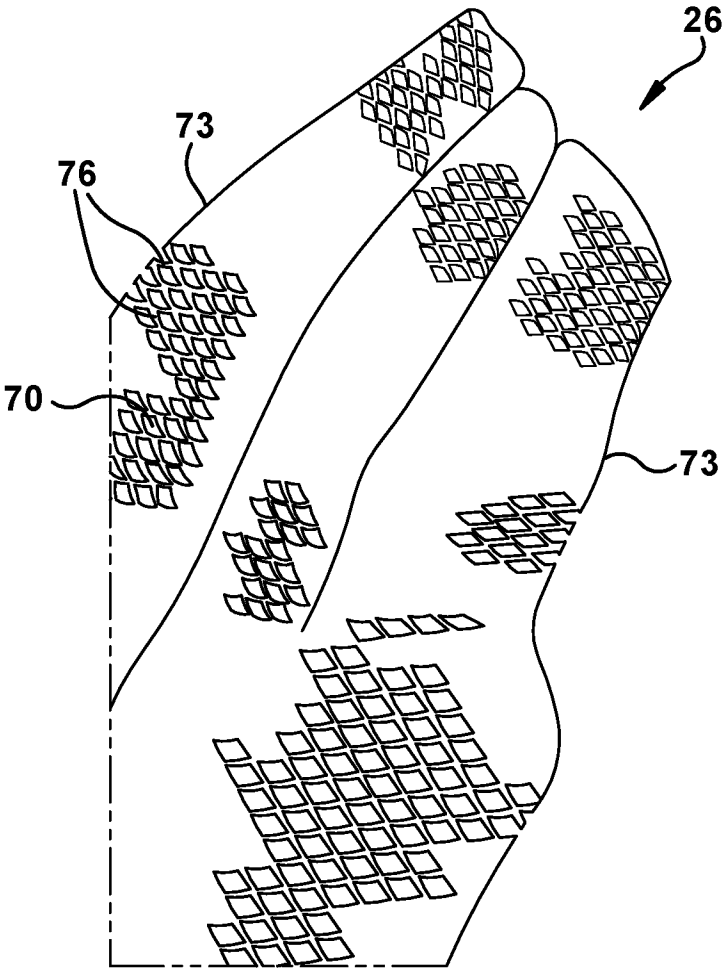
FIG. 5 is perspective view of an exemplary dunnage product made by the exemplary dunnage conversion system shown in FIG. 2.

Turning now to FIG. 5, the present invention also provides a unique exemplary dunnage product 26 that includes at least one ply of randomly crumpled expanded slit sheet stock material 23. The dunnage product 26 has a plurality of spaced rows 76 of expanded slits 70, where the rows 76 each include a plurality of transverse expanded slits 70 intermittently dispersed across the crumpled lateral width of the dunnage product 26. The ply extends in a longitudinal direction along a discrete length and has lateral edges 73 that are inwardly gathered towards one another in a randomly crumpled fashion. The expanded slits 70 in each row 76 are intermittently dispersed across a randomly crumpled lateral direction that is transverse the longitudinal direction. The rows 76 are periodically spaced. The slits 70 are generally expanded in a direction transverse the direction of the slits 70 cut through the ply.

As compared to the initial slit and unexpanded sheet material from which it is formed, the dunnage product 26 is increased in both the longitudinal direction and in thickness, but is reduced in width. The dunnage product 26 has a randomly crumpled lateral width that is generally equivalent to a thickness of the expanded dunnage product 26. Though in other embodiments, the expansion assembly 34 and/or the converging chute 28 may be configured to form a dunnage product 26 having other relative dimensions.

As generally described above, the conversion process includes laterally inwardly gathering the sheet stock material 23, such as the initial ply 30, to converge towards one another, and in the process randomly crumpling sheet stock material 23 to form the modified ply 32. The process also includes expanding the randomly crumpled modified ply 32 longitudinally and in thickness to form the expanded dunnage strip 35 and/or the expanded dunnage product 26. The expanding step includes advancing the modified ply 32 in a longitudinal direction through a pair of driven feed wheels 120 and a pair of pinch rollers 122 disposed upstream of the feed wheels 120. The feed wheels 120 and the pinch rollers 122 cooperate to create tension in the randomly crumpled modified ply 32 to cause the expansion of the slits.

The expanding step also includes driving the pair of feed wheels 120 at a speed faster than a speed of rotation of the pinch rollers 122 to create the tension. The expanding step includes expanding the modified ply 32 travelling between the feed wheels 120 and the pinch rollers 122 while selectively maintaining an untorn length of the expanding modified ply 32 travelling therebetween. The advancing step may include drawing or advancing the sheet stock material 23 from a supply 22 through a converging chute 28 where the laterally inwardly gathering step occurs.

In summary, the present invention provides a dunnage conversion system 20 for expanding an unexpanded slit sheet stock material 23 to form an expanded dunnage product 26. The dunnage conversion system 20 includes a converging chute 28 to inwardly gather laterally-extending edges of sheet stock material 23 towards one another, causing random crumpling of the sheet stock material 23 to form a modified ply 32. The conversion system 20 also includes feed wheels that advance the modified ply 32 through the converging chute 28 and pinch rollers 122 that cooperate with the feed wheels 120 to expand the modified ply 32 traveling between the feed wheels 120 and the pinch rollers 122 to form a dunnage product 26. The expanded dunnage product 26 is expanded both in a longitudinal feed direction and in thickness as compared to the unexpanded slit sheet stock material 23, and thus is a three-dimensional product having increased volume and lower density per unit of length as compared to the unexpanded slit sheet stock material 23.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A method of expanding a sheet stock material having a plurality of transverse slits, the method comprising the steps of:

laterally inwardly gathering the sheet stock material by causing opposed lateral ends of the sheet stock material to converge towards one another to form a randomly crumpled sheet stock material; and expanding the randomly crumpled sheet stock material longitudinally and in thickness to form an expanded dunnage product, where the expanding step includes advancing the sheet stock material in a longitudinal direction through a pair of driven feed wheels and a pair of pinch rollers disposed upstream of the feed wheels, the feed wheels and the pinch rollers cooperating to create tension in the randomly crumpled sheet stock material to cause the expansion of the slits.

2. The method of claim 1, where the expanding step further includes driving the pair of feed wheels at a speed faster than a speed of rotation of the pinch rollers to create the tension.

3. The method of claim 1, where the expanding step further includes expanding the sheet stock material travelling between the feed wheels and the pinch rollers while selectively maintaining an untorn length of the expanding sheet stock material travelling therebetween.

4. The method of claim 1, where the advancing step includes advancing the sheet stock material from a supply through a converging chute where the laterally inwardly gathering step occurs.

5. The method of claim 1, further comprising the step of moving each pinch roller of the pair of pinch rollers towards one another to increase tension on the sheet stock material moving between the pair of pinch rollers and the pair of feed wheels.

6. The method of claim 1, wherein the advancing includes guiding the sheet stock material along the longitudinal direction with guides extending along each of two opposed lateral sides of a feed path extending along the feed direction between the pair of feed wheels and the pair of pinch rollers, the guides extending adjacent the pair of feed wheels and the pair of pinch rollers to prevent binding of the sheet stock material thereabout.

7. The method of claim 6, wherein the advancing includes engaging the sheet stock material with the pair of feed wheels and the pair of pinch rollers through gaps in the guides.

8. The method of claim 6, further comprising the step of constraining a thickness dimension of the sheet stock material with a pair of guide rollers disposed downstream of the pair of feed wheels and the pair of pinch rollers, wherein the thickness dimension is orthogonal to the longitudinal direction and orthogonal to a lateral dimension extending between the guides.

* * * * *